US007588315B2

(12) United States Patent
Lee

(10) Patent No.: US 7,588,315 B2
(45) Date of Patent: Sep. 15, 2009

(54) ARRAY PRINTHEAD AND INKJET IMAGE FORMING APPARATUS HAVING THE SAME

(75) Inventor: Young-su Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/524,187

(22) Filed: Sep. 21, 2006

(65) Prior Publication Data

US 2007/0139470 A1 Jun. 21, 2007

(30) Foreign Application Priority Data

Dec. 21, 2005 (KR) ..... 10-2005-0126930

(51) Int. Cl.
*B41J 2/155* (2006.01)

(52) U.S. Cl. ..... 347/42; 347/49

(58) Field of Classification Search ..... 347/40, 347/42–43, 49, 65

See application file for complete search history.

(56) References Cited

U.S. PATENT DOCUMENTS 6,299,287 B1 10/2001 Williams et al.
6,527,367 B2 3/2003 Yabe
2004/0066430 A1 4/2004 Sekiguchi

FOREIGN PATENT DOCUMENTS

CN 1482966 A 3/2004
JP 2000-289233 10/2000
JP 2000-318188 11/2000

OTHER PUBLICATIONS

Chinese Office Action issued Nov. 7, 2008 in Chinese Application No. 200610149205.1.

*Primary Examiner*—Matthew Luu
*Assistant Examiner*—Justin Seo
(74) *Attorney, Agent, or Firm*—Stanzione & Kim LLP

(57) ABSTRACT

An array printhead and an image forming apparatus having the same. The array printhead includes a first member, a second member, and a third member. The first, second, and third members sequentially overlap and couple to each other. The first member supplies ink of different colors to the second member and the second member separately receives the ink of different colors supplied from the first member and allows the ink to flow to the third member. The third member includes a plurality of head chips. A plurality of supply grooves are formed in a side of the third member on which the plurality of head chips are mounted. The plurality of supply grooves includes a plurality of supply holes that provide the ink of different colors supplied from the second member to the plurality of head chips. The plurality of supply holes are located on an axis different from axes of other adjacent supply holes with respect to a direction perpendicular to a width direction of a print medium.

18 Claims, 7 Drawing Sheets

ARRAY PRINTHEAD AND INKJET IMAGE FORMING APPARATUS HAVING THE SAME

CROSS-REFERENCE TO RELATED APPLICATIONS

This application claims priority under 35 U.S.C. §119 from Korean Patent Application No. 10-2005-0126930, filed on Dec. 21, 2005, in the Korean Intellectual Property Office, the disclosure of which is incorporated herein in its entirety by reference.

BACKGROUND OF THE INVENTION

1. Field of the Invention

The present general inventive concept relates to an inkjet image forming apparatus, and more particularly, to an inkjet image forming apparatus having an array printhead including a nozzle unit of a length that corresponds to the width of paper.

2. Description of the Related Art

An inkjet image forming apparatus is an apparatus which fires ink using a printhead (i.e., a shuttle type printhead) spaced apart a predetermined interval from the front surface of a sheet of paper and which reciprocates in a direction (i.e., the width direction of the sheet of paper) perpendicular to a delivery direction of the sheet of paper to form an image on the sheet of paper. The printhead includes a nozzle unit having a plurality of nozzles to eject ink.

Recently, an attempt has been made to realize high-speed printing by using a printhead (i.e., an array printhead) having a nozzle unit of a length that corresponds to the width of the sheet of paper instead of the shuttle type printhead which reciprocates in the width direction of the sheet of paper. Since the printhead is fixed and only the sheet of paper is moved in the array printhead inkjet image forming apparatus, a driving mechanism is simple and high-speed printing may be realized.

The array printhead may supply ink of a plurality of colors to form a color image. For that purpose, a plurality of supply channels through which ink of the plurality of colors is supplied may be formed at a length that corresponds to the width of the sheet of paper in a lower surface of the array printhead.

However, as described above, since the supply channels which supply ink in the array printhead are formed with a length that corresponds to the width of the sheet of paper, the array printhead is difficult to manufacture and a degree of planarization needs to be managed to properly mount a head chip on the array printhead.

SUMMARY OF THE INVENTION

The present general inventive concept provides an array printhead having ink supply channels, and an inkjet image forming apparatus having the same, capable of mounting a plurality of head chips in a plurality of lines and allowing ink of four colors to be supplied to each of the plurality of head chips.

Additional aspects and advantages of the present general inventive concept will be set forth in part in the description which follows and, in part, will be obvious from the description, or may be learned by practice of the general inventive concept.

The foregoing and/or other aspects of the present general inventive concept may be achieved by providing an array printhead to print an image on a print medium, the array printhead including a first member to supply ink of different colors, a second member to separately receive the ink of different colors supplied from the first member, a third member having a plurality of supply grooves each corresponding to each of a plurality of head chips, the plurality of supply grooves being formed in one side of the third member where the plurality of head chips are mounted, and having a plurality of supply holes each supplying the ink of different colors supplied from the second member, the plurality of supply holes being formed in corresponding ones of the plurality of supply grooves so as to independently supply the ink of different colors to each of the plurality of head chips, wherein the first, second, and third members sequentially overlap and couple to each other, and each of the plurality of supply holes is located on an axis line different from axis lines of adjacent others of the plurality of supply holes in a direction perpendicular to a width direction of the print medium.

The foregoing and/or other aspects of the present general inventive concept may be achieved by providing an inkjet image forming apparatus having a paper feeding element feeding paper in one direction and an array printhead ejecting ink onto the paper to form an image, the array printhead including a first member to supply ink of different colors, a second member to separately receive the ink of different colors supplied from the first member, a third member having a plurality of supply grooves each corresponding to each of a plurality of head chips, the plurality of supply grooves being formed in one side of the third member where the plurality of head chips are mounted, and having a plurality of supply holes each supplying the ink of different colors supplied from the second member, the plurality of supply holes being formed in corresponding ones of the plurality of supply grooves so as to independently supply the ink of different colors to each of the plurality of head chips, wherein the first, second, and third members sequentially overlap and couple to each other, and each of the plurality of supply holes is located on an axis line different from axis lines of adjacent others of the plurality of supply holes in a direction perpendicular to a width direction of the paper.

The foregoing and/or other aspects of the present general inventive concept may be achieved by providing an array printhead usable in an image forming apparatus, including an array printhead usable in an image forming apparatus, including a member to receive ink of different colors in a first direction, and having a plurality of inlet holes spaced apart from each other in a second direction to receive the corresponding ink of different colors in the first direction, a plurality of ink channels to communicate with corresponding ones of the plurality of the inlet holes and to direct the corresponding ink of the different colors in the second direction, a plurality of channel groove groups disposed in the second direction, each group having channel grooves to communicate with corresponding ones of the plurality of ink channels and to direct the corresponding ink of different colors in a third direction, and a plurality of head chips disposed in the second direction to correspond to respective ones of the channel groove groups, each of the plurality of head chips having a plurality of nozzle lines disposed in the third direction, each nozzle line receiving the corresponding ink of different colors from corresponding ones of the channel groove.

The member may include a plurality of supply holes formed on corresponding ones of the channel grooves of the each channel groove group, and a plurality of supply grooves disposed in the second direction to correspond to corresponding nozzle lines to direct the corresponding ink of different colors to the corresponding nozzle lines.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
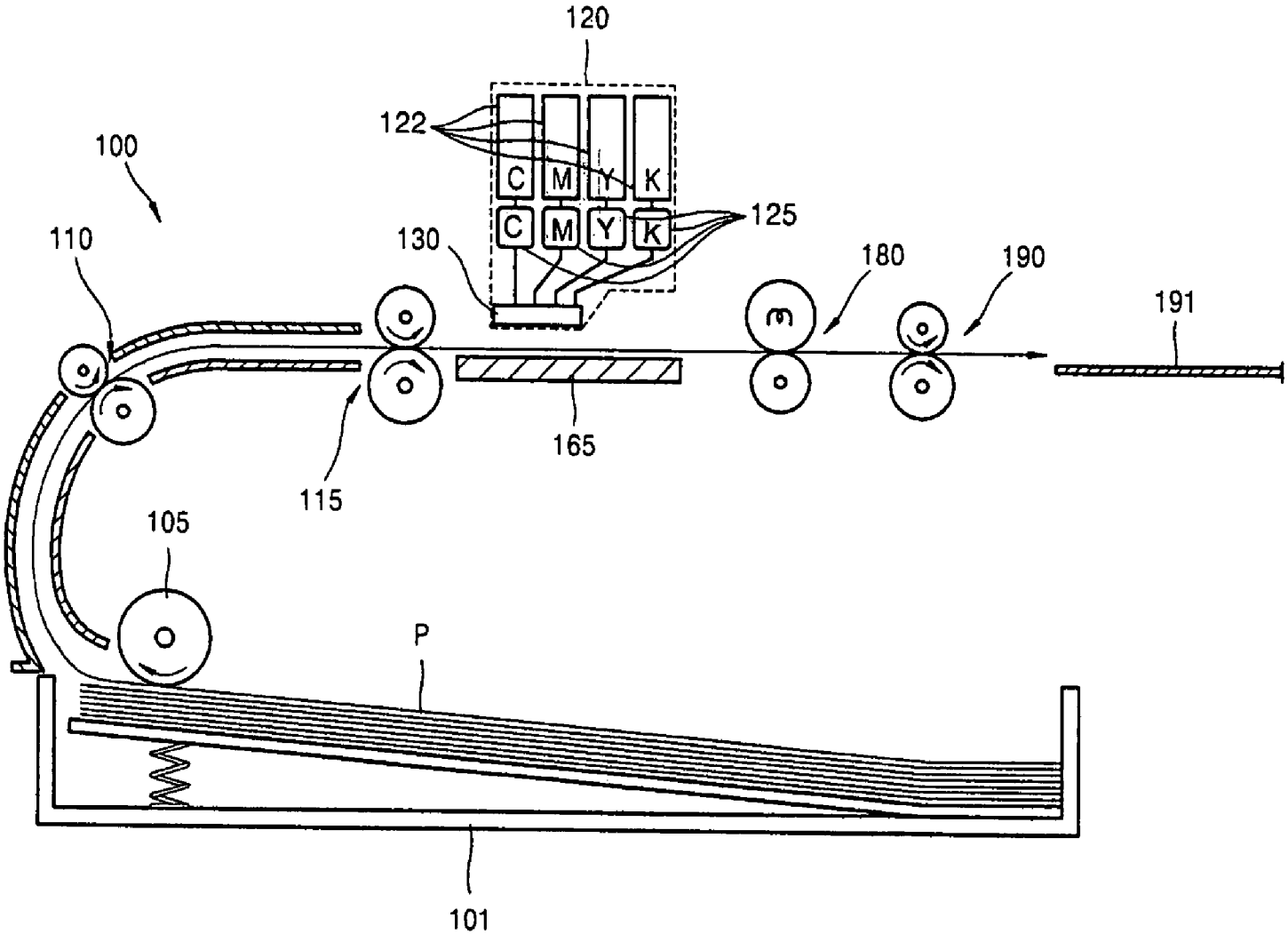
FIG. 1 is a view illustrating an inkjet image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Referring to FIG. 1, an inkjet image forming apparatus 100 includes a paper feeding element to feed a printing medium, such as a sheet of paper P, in one direction and an array printhead 130 to eject ink onto the paper P to form an image on the paper P.

The paper feeding element may include feeding rollers 110 to feed the paper P such that the paper P passes through a paper path below the array printhead 130 and discharge rollers 190 to discharge the paper P on which the image is formed by ejection of the ink to a paper-discharging tray 191. The paper feeding element may also include a paper pickup roller 105 to pick up the paper P stacked in the paper-supply cassette 101.

Each of the feeding rollers 110 and the discharge rollers 190 has a pair of rollers which may include a drive roller and a driven roller installed to press against each other, and the paper P progresses between contact surfaces where the drive roller and the driven roller of the respective feeding and discharge rollers are pressed to contact each other. A reference numeral 115 is a pair of registration rollers to align the paper P in order to form the image on a desired portion of the paper P.

The inkjet image forming apparatus 100 includes the paper-supply cassette 101 in which the paper P on which the image is to be printed is stacked, and the pickup roller 105 to pick up the paper P sheet by sheet stacked in the paper-supply cassette 101. Also, the inkjet image forming apparatus 100 further includes a dryer 180 to dry the image formed on the paper P by the ejection of ink. Since the inkjet image forming apparatus 100 having the array printhead 130 has a high printing speed, the paper P may not be sufficiently dried as it is successively stacked on the paper-discharging tray 191, which may cause ink spreading. The drier 180 prevents a printing defect due to the ink spreading by rapidly drying an image.

An ink cartridge 120 is located between the registration rollers 115 and the drier 180.

The ink cartridge 120 includes four ink tanks 122C, 122M, 122Y, and 122K which respectively receive ink of four colors of cyan (C), magenta (M), yellow (Y), and black (K), four negative pressure regulators 125C, 125M, 125Y, and 125K, and the array printhead 130 therein.

The negative pressure regulators 125C, 125M, 125Y, and 125K regulate negative pressures of ink which flows to the array printhead 130 from the four ink tanks 122C, 122M, 122Y, and 122K to prevent air bubbles from penetrating into the inside of the array printhead 130 (refer to FIG. 3) or prevent the ink from leaking out unnecessarily.

A platen 165 is located below the array printhead 130 to support the paper P containing the image thereon and to pass the paper P through the paper path below the array printhead 130. By use of the platen 165, a uniform interval is maintained between the array printhead 130 and the paper P as it passes through the paper path below the array printhead 130.

Figure 2:
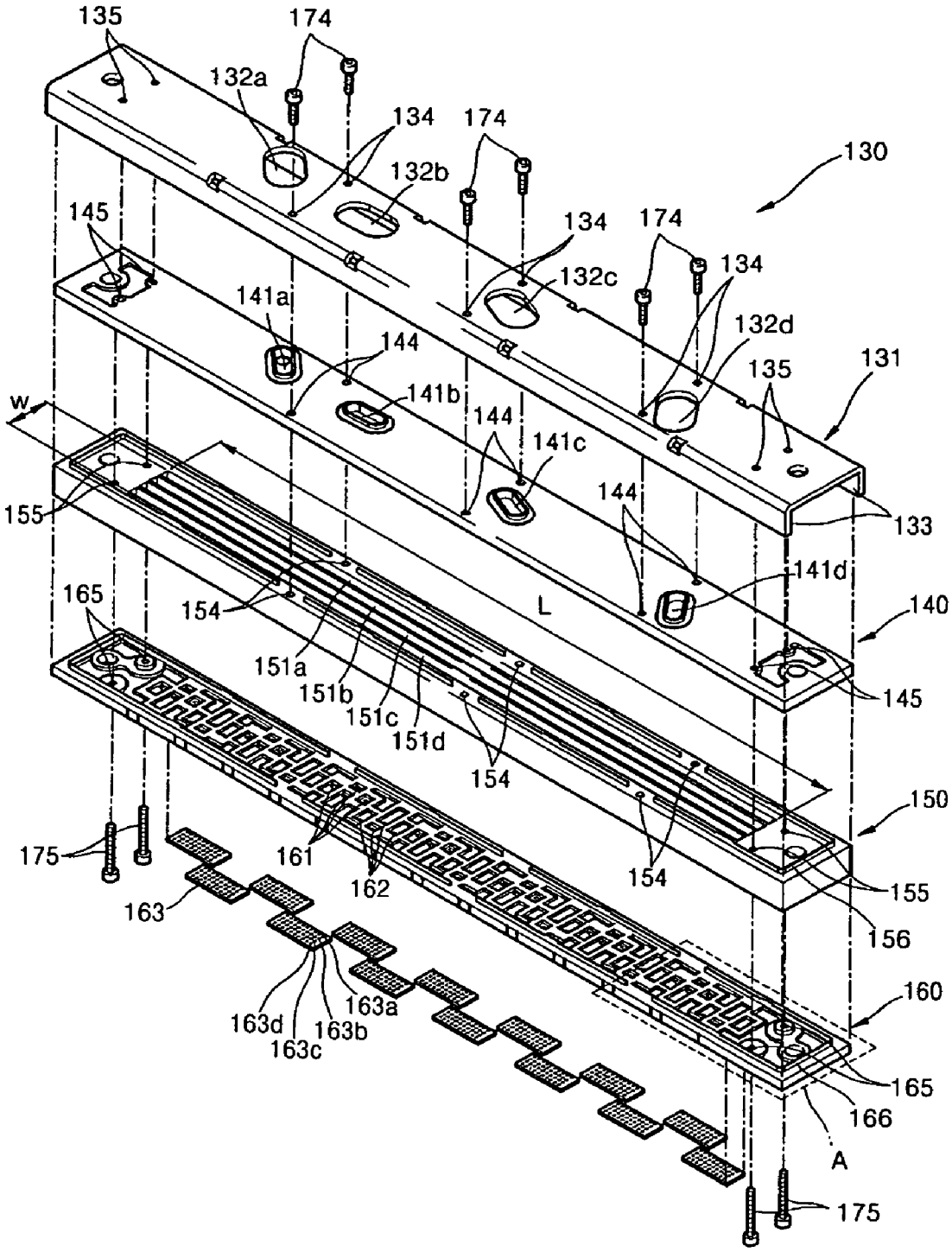
FIG. 2 is an exploded perspective view illustrating an array printhead usable with an image forming apparatus according to an embodiment the present general inventive concept.
Figure 3:
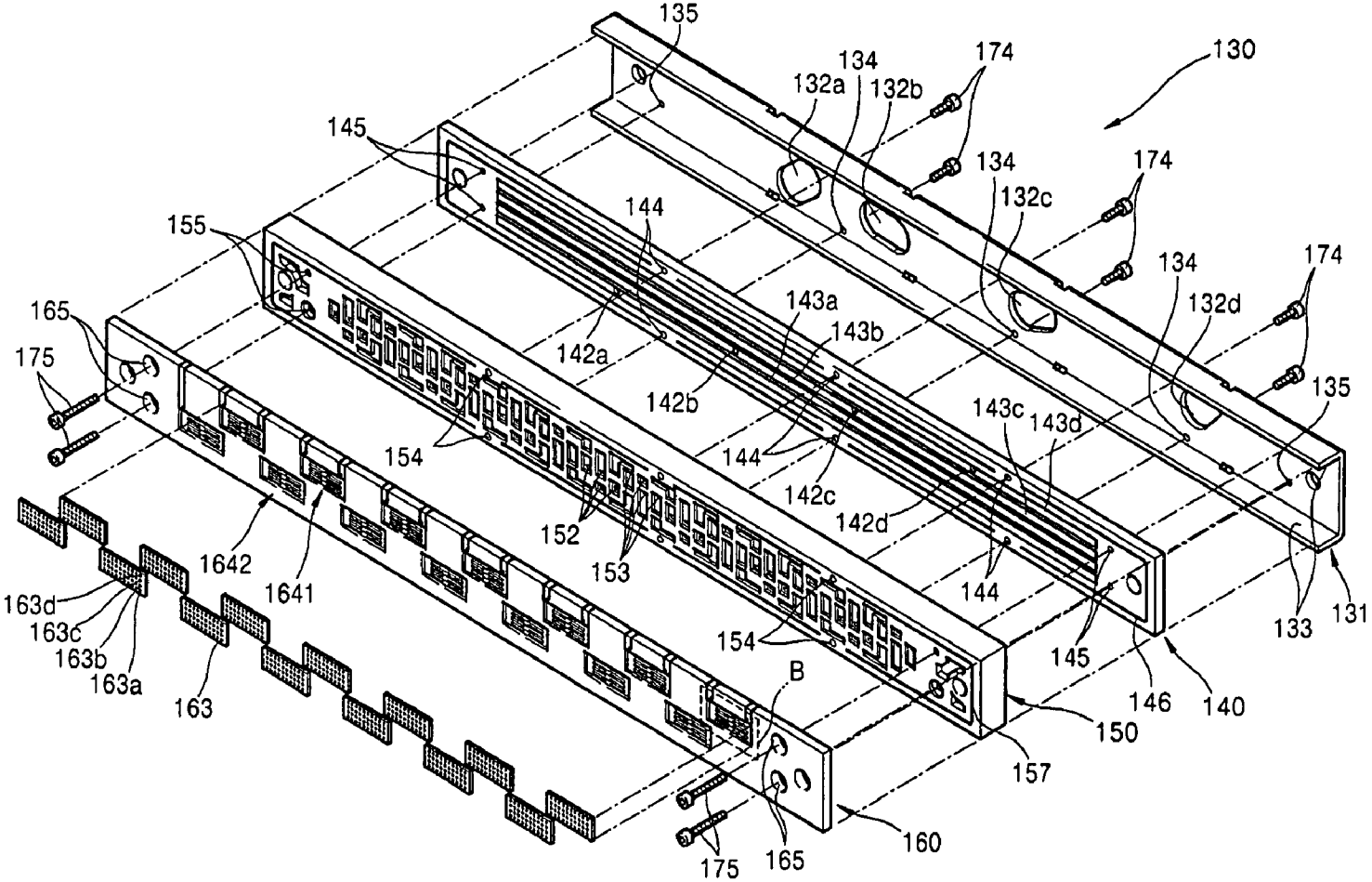
FIG. 3 is an exploded perspective view illustrating a backside of the array printhead of FIG. 2.

Referring to FIGS. 2 and 3, the array printhead 130 includes a support member 131, a first member 140, a second member 150, and a third member 160, which sequentially overlap and couple with each other in a first direction.

The first, second, and third members 140, 150, and 160 are respectively formed by molding liquid crystal polymer, which is a polymer resin. The liquid polymer has excellent molding properties, excellent chemical durability, and a high resistance against twisting due to external forces. The liquid polymer is a material having excellent measurement stability and thus is appropriate for the printhead 130 which requires a high degree of planarization and a high degree of accuracy in measurement.

The support member 131 includes guide holes 132*a*, 132*b*, 132*c*, and 132*d* to receive ink of different colors, and first and second coupling holes 134 and 135. The guide holes 132*a*, 132*b*, 132*c*, and 132*d* are spaced apart by a distance in a second direction having an angle with the first direction.

The first member 140 includes four inlet holes 141*a*, 141*b*, 141*c*, and 141*d* formed to allow ink of four colors of cyan, magenta, yellow, and black from the four negative pressure regulators 125C, 125M, 125Y, and 125K (refer to FIG. 2) through the guide holes 132*a*, 132*b*, 132*c*, and 132*d* to flow into an inside of the array printhead 130 (i.e., four channels 151*a*, 151*b*, 151*c*, and 151*d* of the second member 150). In detail, ink of cyan, magenta, yellow, and black may flow through a first inlet hole 141*a*, a second inlet hole 141*b*, a third inlet hole 141*c*, and a fourth inlet hole 141*d*, respectively. Four channels 143*a*, 143*b*, 143*c*, and 143*d* are formed in a lower surface of the first member 140 to separately receive the ink of four colors of C, M, Y, and K, which have flowed in through the four inlet holes 141*a*, 141*b*, 141*c*, and 141*d*. Through holes 142*a*, 142*b*, 142*c*, and 142*d* are formed in the respective four channels 143*a*, 143*b*, 143*c*, and 143*d* to communicate with the four inlet holes 141*a*, 141*b*, 141*c*, and 141*d*, respectively.

The second member 150 includes the four channels 151*a*, 151*b*, 151*c*, and 151*d* disposed in a third direction having an angle with the second direction to separately receive ink of four colors of C, M, Y, and K, which has flowed in through the four through holes 142*a*, 142*b*, 142*c*, and 142*d*, respectively. The channels 151*a*, 151*b*, 151*c*, and 151*d* are mutually parallel to the width direction of the paper P, i.e., a length direction of the array printhead 130 or a direction perpendicular to a paper feeding direction of the paper P. The four channels 151*a*, 151*b*, 151*c*, and 151*d* may receive cyan ink, magenta ink, yellow ink, and black ink, respectively. The first angle may be 90 degrees with respect to the second and third angles, and the second angle may be 90 degrees with respect to the third angle.

The four channels 143*a*, 143*b*, 143*c*, and 143*d* are also formed in a lower surface of the first member 140 in a same pattern as the four channels 151*a*, 151*b*, 151*c*, and 151*d* formed in an upper surface of the second member 150. With this construction, the channels 143*a*, 143*b*, 143*c*, and 143*d* of the first member 140 face the four channels 151*a*, 151*b*, 151*c*, and 151*d* of the second member 150, so that sufficient ink receiving spaces may be provided for the ink of four colors of C, M, Y, and K, respectively.

A rib 156 is protruded from the periphery of the upper surface of the second member 150 and a groove 146 is formed in a periphery of the lower surface of the first member 140 to receive the rib 156 of the second member 150. The rib 156 and the groove 146 serve as references when the first member 140 and the second member 150 are attached to each other. The rib 156 and the groove 146 may suppress bending and twisting of the first member 140 and the second member 150, thereby improving sealing between the first member 140 and the second member 150.

The array printhead 130 may include a plurality of head chips 163 arranged in a zigzag with respect to the width direction of paper (i.e., the length direction of the array printhead 130), so that the head chips 163 form a plurality of head chip lines.

A plurality of head chip mounting parts 1641 and 1642 each constituting the plurality of head chip lines may also be formed in a zigzag in a backside of the third member 160 so that each of the plurality of head chips 163 may be mounted on each of the plurality of head chip mounting parts 1641 and 1642.

A plurality of channel groove groups 161 and 162, each channel groove group serving as a flowing passage of ink that has flowed from the second member 150, may be formed in an upper surface of the third member 160.

To supply ink to the head chip mounting parts 1641 and 1642, respectively, the plurality of channel groove groups 161 and 162 of the third member 160 may be repeatedly formed in the length direction of the array printhead 130 to correspond to the arrangement of the head chips 163. That is, the plurality of channel groove groups 161 and 162 may be formed in the zigzag. Therefore, cyan ink, magenta ink, yellow ink, and black ink may be respectively supplied to a first nozzle line 163*a*, a second nozzle line 163*b*, a third nozzle line 163*c*, and a fourth nozzle line 163*d* formed on the head chip 163 in the second direction. The ink of four colors may be supplied to one chip, so that "1-head chip 4-colors" can be achieved.

A plurality of second channel groove groups 152 and 153 may also be formed on the lower surface of the second member 150 in a same pattern as a pattern of the channel groove groups 161 and 162 of the third member 160.

A rib 166 may protrude from a periphery of the upper surface of the third member 160 and a second groove 157 may be formed in a periphery of the lower surface of the second member 150 to receive the rib 166. The second rib 166 and the second groove 157 serve as references when the second member 150 and the third member 160 are attached to each other. The second rib 166 and the second groove 157 suppress bending and twisting of the second member 150 and the third member 160, thereby improving sealing between the second member 150 and the third member 160.

Figure 5:
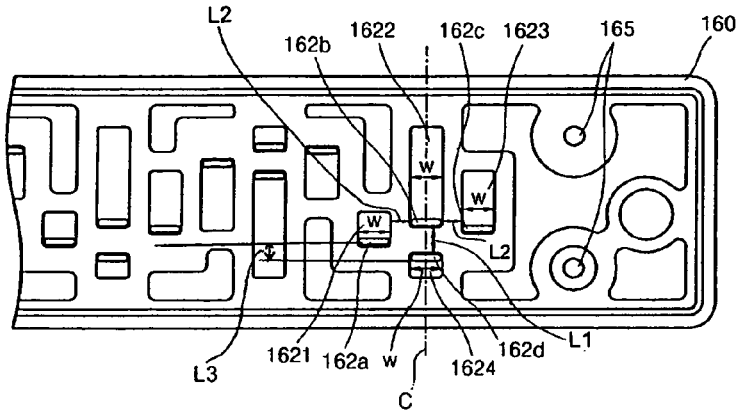
FIG. 5 is a partial enlarged view illustrating a portion A of FIG. 2.

Referring to FIGS. 2, 3, and 5, the channel groove group 162 includes four channel grooves 1621, 1622, 1623, and 1624. The channel grooves 1621, 1622, 1623, and 1624 may have a same width W and different lengths. Supply holes 162*a*, 162*b*, 162*c*, and 162*d*, respectively, which supply ink of four colors to a head chip mounting part 1642, may be formed at ends of the channel grooves 1621, 1622, 1623, and 1624, respectively, to pass through the head chip mounting part 1642. The supply holes 162*a*, 162*b*, 162*c*, and 162*d* correspond to the first, second, third, and fourth nozzle lines 163*a*, 163*b*, 163*c*, and 163*d*, respectively.

As illustrated in FIG. 5, assuming that the supply holes 162*b* and 162*d* are first supply holes and the supply holes 162*a* and 162*c* are second supply holes, the first supply holes 162*b* and 162*d* may be spaced apart from each other by a distance L1 in a direction (third direction) perpendicular to a width (second direction) of paper P and located on a same vertical axis line C. The first supply hole 162*b* may be a horizontal distance L2 away from either of the second supply holes 162*a* or 162*c* in the second direction. The first supply hole 162*b* may also be a vertical distance L3 (where L3=[1/3]*[L1]) away from the second supply hole 162*a* in the third direction, and may also be the vertical distance L3 from the second supply hole 162*c* in the third direction. The first supply hole 162*d* may also be the vertical distance L3 away from the second supply hole 162*a* and the second supply hole 162*c* in the third direction. That is, the first supply holes 162*b* and 162*d* may be located to face each other on the vertical axis line C (third direction) and may be spaced apart by the distance L1 which is greater than the horizontal distance L2 between either of the second supply holes 162*a* and 162*c* and the axis line C in the second direction. The distance L1 between the first supply holes 162*b* and 162*d* may also be greater than the vertical distance L3 between individual ones of the second supply holes 162*a* and 162*c* and the first supply holes 162*b* and 162*d* in the third direction. In other words, the distance L1 may be greater than the horizontal distance L2 in the second direction or the vertical distance L3 in the third direction. The horizontal distance L2 and the vertical distance L3 may be less than the width W.

The second supply holes 162*a* and 162*c* may be spaced apart from the first supply holes 162*b* and 162*d* by as much as the distance L2 on both sides of the vertical axis line C of the first supply holes 162*b* and 162*d*, in a direction (second direction) of the width of the paper P and perpendicular to the vertical axis line C (third direction).

Referring again to FIGS. 2, 3, and 5, the channel grooves 1621, 1622, 1623, and 1624 may be spaced apart from one another by as much as distances L1 and L2 without overlapping one another. Sealant may be coated on spaced portions of the third member 160 between the channel grooves 1621, 1622, 1623, and 1624 in order for coupling of the third member 160 with the second member 150. Since the spaced portions between the channel grooves 1621, 1622, 1623, and 1624 may be symmetrically formed with respect to the first supply holes 162*b* and 162*d*, it is possible to uniformly coat the sealant between the channel grooves 1621, 1622, 1623, and 1624. Accordingly, the channel grooves 1621, 1622, 1623, and 1624 and the supply holes 162*a*, 162*b*, 162*c*, and 162*d* may form supply passages between the second member 150 and the third member 160 which supply the ink of four colors to head chip 163.

As described above, it is possible to provide the supply passages through which ink of different colors may be supplied securely and without being mixed by providing the above arrangement with respect to the supply holes 162*a*, 162*b*, 162*c*, and 162*d* and the channel grooves 1621, 1622, 1623, and 1624. Also, it is possible to stably secure a bonding space in which an adhesive may be coated so that the third member 160 may be coupled to the second member 150.

Referring to FIGS. 2 and 3, the head chip 163 includes four nozzle lines 163*a*, 163*b*, 163*c*, and 163*d* formed in parallel to the width direction (second direction) of the paper P to eject the ink of different colors. In detail, cyan ink, magenta ink, yellow ink, and black ink may be respectively supplied to a nozzle line 163*a*, a nozzle line 163*b*, a nozzle line 163*c*, and a nozzle line 163*d* formed on the head chip 163. Therefore, the ink of four colors is supplied to one chip, so that '1-head chip 4-colors' is achieved.

Figure 6:
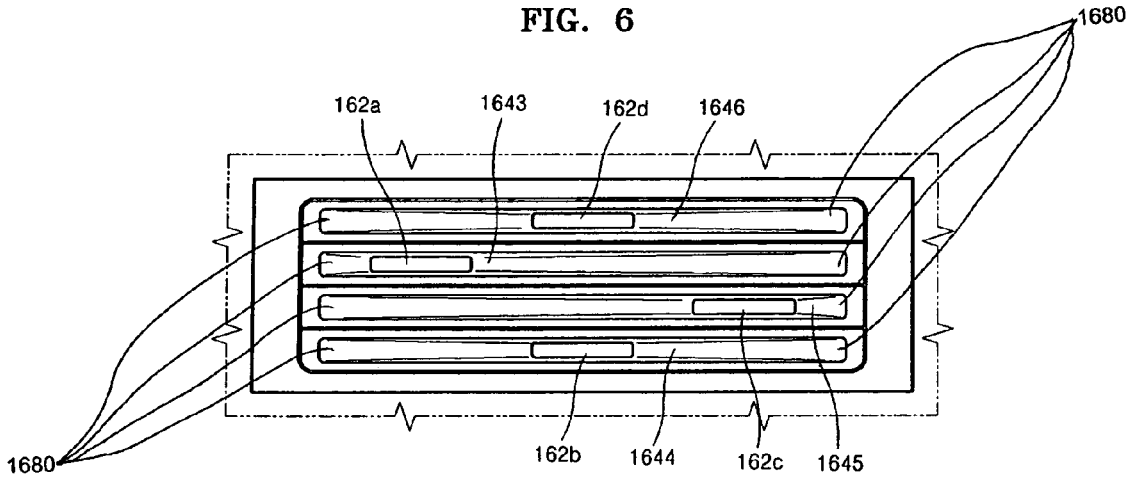
FIG. 6 is a partial enlarged view illustrating a portion B of FIG. 3.
Figure 9:
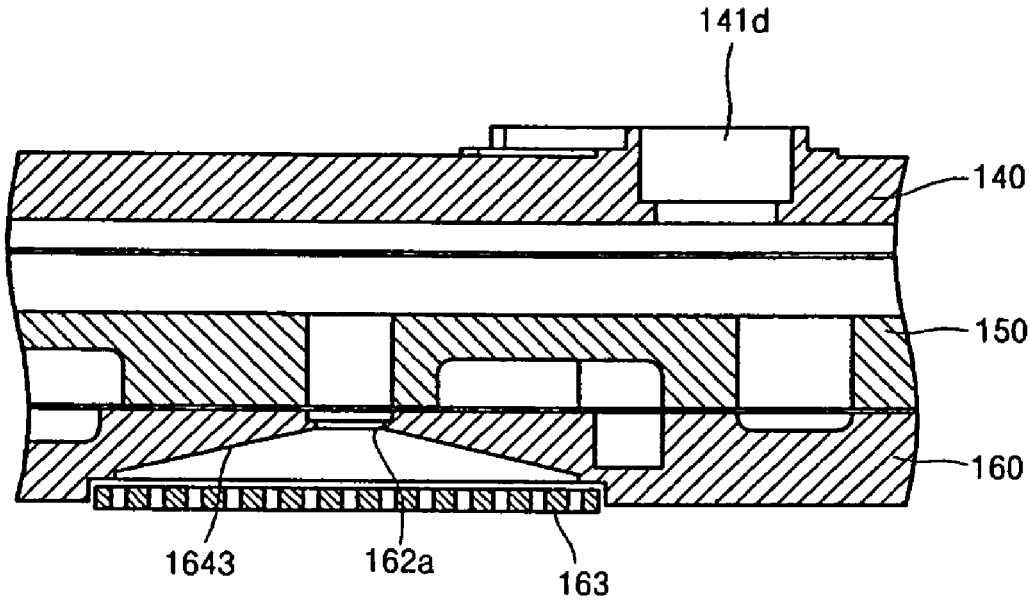
FIG. 9 illustrates a sectional view taken along a line V-V' of FIG. 4.

Referring to FIGS. 3, 6 and 9, an embodiment of the present general inventive concept with respect to an arrangement of the portion B of FIG. 3 will be explained. A head mounting part 1642 (FIG. 3) includes a plurality of supply grooves 1643, 1644, 1645, and 1646 formed in parallel to a width direction of paper P. The supply grooves 1643, 1644, 1645, and 1646 supply ink of different colors to corresponding nozzle lines 163*a*, 163*b*, 163*c*, and 163*d* of the head chip 163 mounted on the head mounting part 1642.

Each of the plurality of supply grooves 1643, 1644, 1645, and 1646 communicates with each of plural channel grooves 1621, 1622, 1623, and 1624 through supply holes 162*a*, 162*b*, 162*c*, and 162*d*.

The plurality of supply grooves 1643, 1644, 1645, and 1646 may have slopes 1680 formed to be inclined on both sides of the supply holes 162*a*, 162*b*, 162*c*, and 162*d* along a direction from the supply holes 162*a*, 162*b*, 162*c*, and 162*d* to a lower surface of the head chip mounting part 1642 (i.e., a direction toward the head chip 163 in FIG. 3). Therefore, as illustrated in FIG. 9 which is a sectional view taken along a line V-V' of FIG. 4, ink may be supplied through an inlet hole 141*d* of a first member 140 and through ink supply passages formed by a second member 150 and a third member 160. Then, the ink that has flowed into the supply grooves 1643, 1644, 1645, and 1646 through the supply holes 162*a*, 162*b*, 162*c*, and 162*d* may be uniformly supplied along inclined portions of the supply grooves 1643, 1644, 1645, and 1646 to the nozzle lines 163*a*, 163*b*, 163*c*, and 163*d* of the head chip 163.

Figure 7:
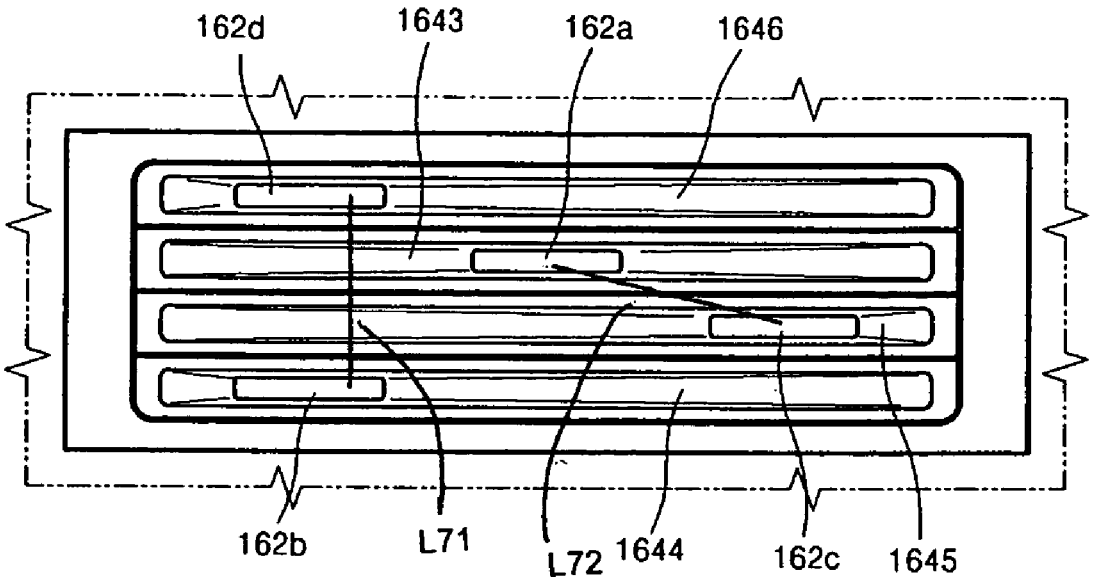
FIG. 7 is a partial enlarged view illustrating a modification of the portion B of FIG. 3.
Figure 8:
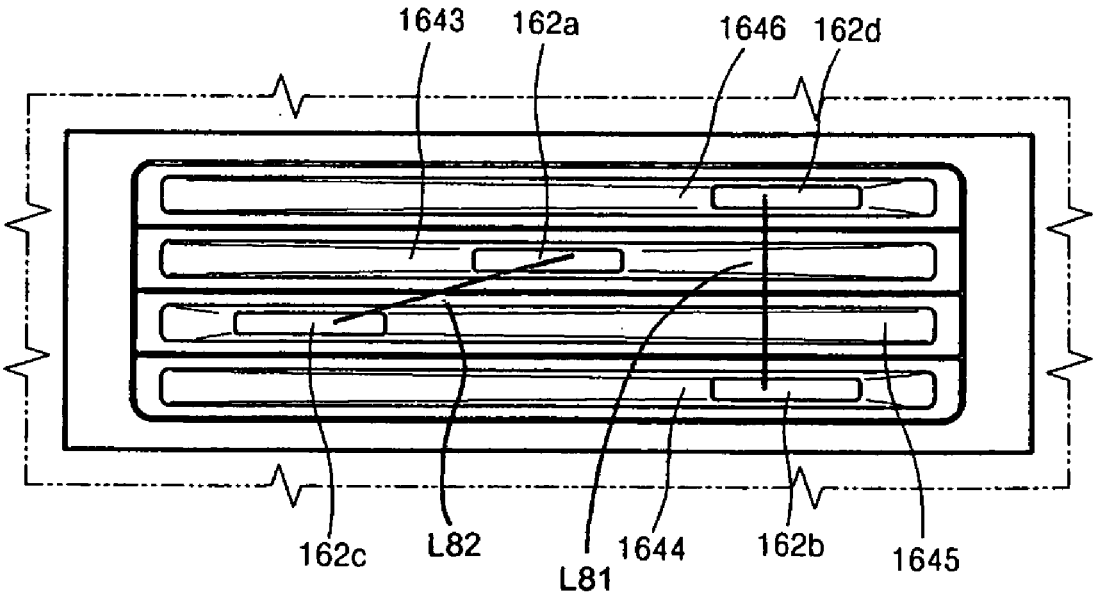
FIG. 8 is a partial enlarged view illustrating another modification of the portion B of FIG. 3.

Referring to FIGS. 7 and 8, the supply holes 162*a*, 162*b*, 162*c*, and 162*d* are arranged differently from those in FIGS. 5 and 6. That is, referring to FIG. 7, the second supply holes 162*a* and 162*c* are arranged to a right side of the first supply holes 162*b* and 162*d*. Referring to FIG. 8, the second supply holes 162*a* and 162*c* are arranged to a left side of the first supply holes 162*b* and 162*d*.

It is possible to stably secure a space on which sealant is coated between the supply holes 162*a*, 162*b*, 162*c*, and 162*d* with an arrangement where a spaced distance (L71 in FIG. 7 or L81 in FIG. 8) between the first supply holes 162*b* and 162*d* is set to be equal to a spaced distance (L72 in FIG. 7 or L82 in FIG. 8) between the second supply holes 162*a* and 162*c*.

When the sealant is hardened at a predetermined temperature with the sealant coated between the channel grooves 1621, 1622, 1623, and 1624 of FIG. 5 and the head chip 163 of FIGS. 2, 3, and 9 mounted on the head chip mounting part 1642 of FIG. 3, a gas of high temperature and high pressure is generated. At this point, when the generated gas remains without being exhausted, the gas exerts stress on the head chip 163. Furthermore, stress is added to the head chip 163 due to a difference in linear expansion coefficients during contraction.

Referring to FIGS. 5, 6, 7, and 8, it is possible to prevent the stress from being concentrated on only one portion of the head chip 163 by providing the supply holes 162*a*, 162*b*, 162*c*, and 162*d* to uniformly distribute the stress due to the gas generated when the sealant is hardened over the entire head chip 163.

Figure 4:
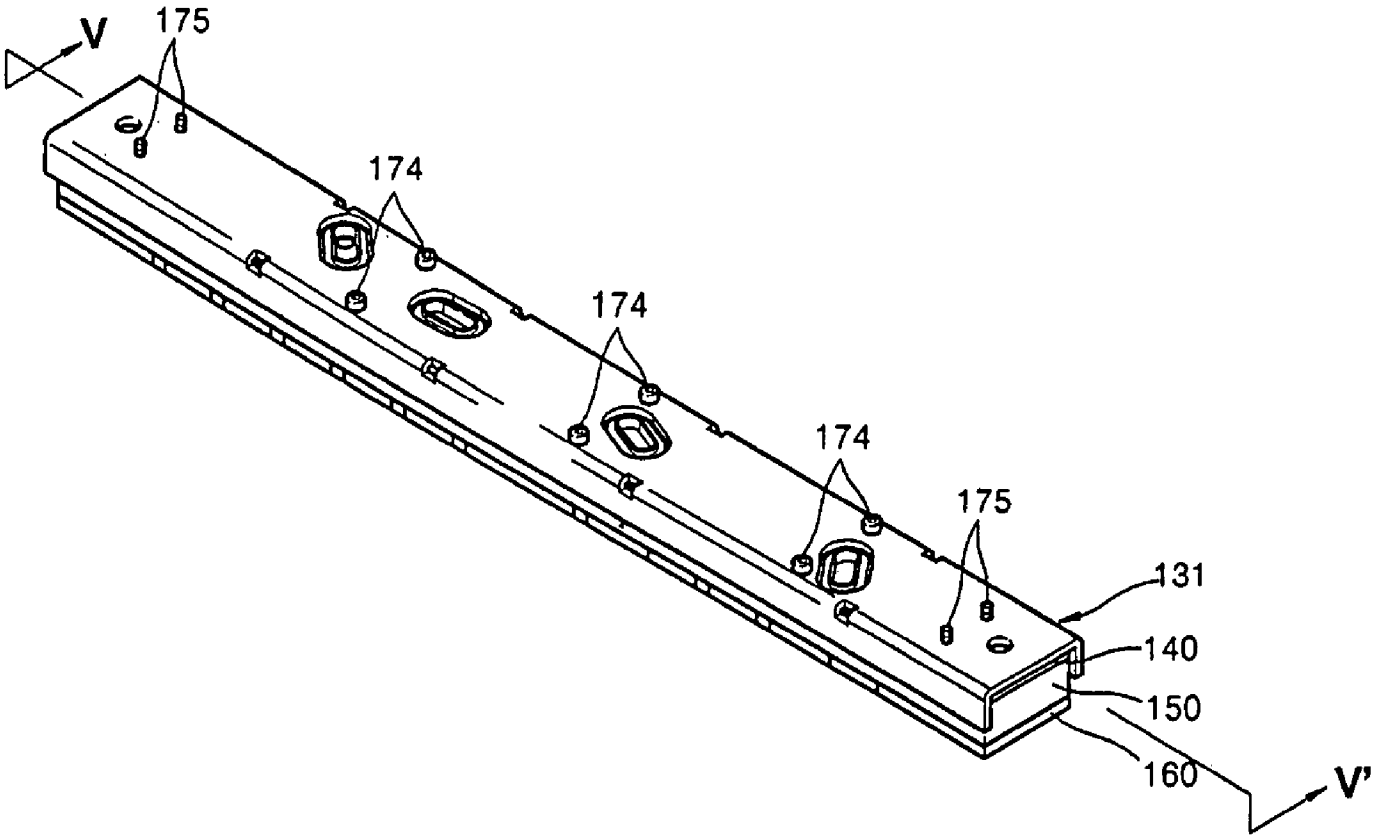
FIG. 4 is a perspective view illustrating the array printhead of FIG. 2.

Referring to FIGS. 2, 3, and 4, channel groove groups 152 and 153 may also be formed in a lower surface of the second member 150 in a same pattern as a pattern of the channel groove groups 161 and 162 formed in an upper surface of the third member 160.

A rib 166 (FIG. 2) protrudes from a periphery of the upper surface of the third member 160 and a groove 157 (FIG. 3) to receive the rib 166 may be formed in a periphery of the lower surface of the second member 150. The rib 166 and the groove 157 allow the second member 150 and the third member 160 to be cooperatively bonded to each other. When the sealant is coated on a space between the channel groove groups 161 and 162 of the third member 160 and the channel groove groups 152 and 153 of the second member 150 to bond the third member 160 to the second member 150, the third member 160 and the second member 150 are closely attached to each other and the channel groove groups 161 and 162 of the third member 160 and the channel groove groups 152 and 153 of the second member 150 constitute ink supply channels or supply passages.

The first, second, and third members 140, 150, and 160 are vertically coupled to a support member 131 using a coupling element. For that purpose, as illustrated in FIGS. 2, 3, and 4, the coupling element may include the first coupling parts 174 that sequentially couple the support member 131, the first member 140, and the second member 150 vertically from a first side of the support member 131, and second coupling parts 175 that sequentially couple the third member 160, the second member 150, the first member 140, and the support member 131 vertically from a second side of the support member 131.

The support member 131 includes the first and second coupling holes 134 and 135. The first member 140 includes first and second coupling holes 144 and 145, the second member 150 includes first and second coupling holes 154 and 155, and the third member 160 includes second coupling holes 165. Accordingly, the first coupling part 174 is coupled in the first coupling holes 134, 144, and 154, and the second coupling part 175 is coupled in the second coupling holes 135, 145, 155, and 165.

As described above, the array printhead according to the present general inventive concept has the following effects.

The present general inventive concept may provide a uniform width of a channel groove for each color to swiftly supply ink.

The present general inventive concept may provide maximum adhesive area to enhance adhesive force when bonding is performed with an adhesive.

A plurality of supply holes may be arranged such that stress is not concentrated only at one portion of a head chip.

Since adhesive force is reinforced, mixing of colors and leakage of ink may be prevented.

An adhesive surface is formed in a uniform pattern, so that an adhesive process may be easily performed.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An array printhead comprising:

a plurality of head chips arranged along the array printhead in a direction perpendicular to paper feeding direction and each comprising a plurality of nozzle lines, which correspond to ink of different colors, formed in the direction perpendicular to the paper feeding direction to be parallel to one another; and a plurality of members overlapping and coupling to one another and each having a plurality of passages through which the ink of different colors are supplied to the plurality of head chips, wherein among the plurality of members, a member on which the plurality of head chips are mounted has a plurality of supply holes that correspond to the plurality of nozzle lines of each of the plurality of head chips and allow the ink of different colors to be supplied therethrough, wherein the plurality of supply holes comprise two first supply holes formed on a common axis that is parallel to the paper feeding direction and a distance between the two first supply holes is greater than any of distances between the supply holes in the paper feeding direction.

2. The array printhead of claim 1, wherein the plurality of supply holes comprise two second supply holes formed in both sides of the common axis.

3. The array printhead of claim 2, wherein distances of the two second supply hole from the common axis are equal to each other.

4. The array printhead of claim 1, wherein the plurality of supply holes comprise two second supply holes formed in one side of the common axis.

5. The array printhead of claim 4, wherein a distance between the two second supply holes is equal to a distance between the common axis and one second supply hole that is closer to the common axis than the other second supply hole.

6. The array printhead of claim 1, wherein widths, each of which is defined in the direction perpendicular to the pa per feeding direction, of the plurality of supply holes are equal to one another, and lengths, each of which is defined in the paper feeding direction, of the plurality of supply holes are equal to one another.

7. The array printhead of claim 1, wherein a plurality of channel grooves, which communicate with the plurality of supply holes, are formed in one surface of the member having the plurality of supply holes.

8. The array printhead of claim 7, wherein widths, each of which is defined in the direction perpendicular to the paper feeding direction, of the plurality of channel grooves are equal to one another, but lengths, each of which is defined in the paper feeding direction, of the plurality of channel grooves are different from one another.

9. The array printhead of claim 1, wherein a plurality of supply grooves, which communicate with the plurality of supply holes and each are wider toward the plurality of head chips, are formed in the other surface of the member, which has the plurality of supply holes, to be parallel to the plurality of nozzle lines.

10. An inkjet image forming apparatus comprising:

a paper feeding element feeding paper in one direction; and an array printhead forming an image by ejecting ink to the paper, wherein the array printhead comprises:

a plurality of head chips arranged in a direction perpendicular to a paper feeding direction and each comprising a plurality of nozzle lines, which correspond to ink of different colors, formed in the direction perpendicular to the paper feeding direction to be parallel to one another; and a plurality of members overlapping and coupling to one another and each having a plurality of passages through which the ink of different colors are supplied to the plurality of head chips, wherein among the plurality of members, a member on which the plurality of head chips are mounted has a plurality of supply holes that correspond to the plurality of nozzle lines of each of the plurality of head chips and allow the ink of different colors to be supplied therethrough, wherein the plurality of supply holes comprise two first supply holes formed on a common axis that is parallel to the paper feeding direction and a distance between the two first supply holes is greater than any of distances between the supply holes in the paper feeding direction.

11. The inkjet image forming apparatus of claim 10, wherein the plurality of supply holes comprise two second supply holes formed in both sides of the common axis.

12. The array printhead of claim 11, wherein distances of the two second supply holes from the common axis are equal to each other.

13. The array printhead of claim 10, wherein the plurality of supply holes comprise two second supply holes formed in one side of the common axis.

14. The array printhead of claim 13, wherein a distance between the two second supply holes is equal to a distance between the common axis and one second supply hole that is closer to the common axis than the other second supply hole.

15. The array printhead of claim 10, wherein widths, each of which is defined in the direction perpendicular to the paper feeding direction, of the plurality of supply holes are equal to one another, and lengths, each of which is defined in the paper feeding direction, of the plurality of supply holes are equal to one another.

16. The array printhead of claim 10, wherein a plurality of channel grooves, which communicate with the plurality of supply holes, are formed in one surface of the member having the plurality of supply holes.

17. The array printhead of claim 16, wherein widths, each of which is defined in the direction perpendicular to the paper feeding direction, of the plurality of channel grooves are equal to one another, but lengths, each of which is defined in the paper feeding direction, of the plurality of channel grooves are different from one another.

18. The array printhead of claim 10, wherein a plurality of supply grooves, which communicate with the plurality of supply holes and each are wider toward the plurality of head chips, are formed in the other surface of the member, which has the plurality of supply holes, to be parallel to the plurality of nozzle lines.

* * * * *